United States Patent [19]

Le Mer

[11] Patent Number: 4,657,147

[45] Date of Patent: Apr. 14, 1987

[54] FILING DRUM

[76] Inventor: Gerard Le Mer, 12 Chemin du Milieu, 95540 Mery-sur-Oise, France

[21] Appl. No.: 751,253

[22] Filed: Jul. 2, 1985

[30] Foreign Application Priority Data

Jul. 10, 1984 [FR] France ..... 84 10949

[51] Int. Cl.[4] ..... B47F 5/02

[52] U.S. Cl. ..... 211/58; 211/131; 211/163

[58] Field of Search ..... 211/58, 78, 131, 163, 211/184

[56] References Cited

U.S. PATENT DOCUMENTS

| | | | |
|---|---|---|---|
| 418,809 | 1/1890 | Mundy | 211/58 X |
| 2,118,444 | 5/1938 | Mueller | 211/131 |
| 3,203,748 | 8/1965 | Toms . | |
| 3,244,289 | 4/1966 | King . | |
| 4,056,194 | 11/1977 | Radek | 211/131 |

FOREIGN PATENT DOCUMENTS

| | | |
|---|---|---|
| 36323 | 10/1969 | Australia . |
| 279305 | 3/1952 | Sweden . |
| 843711 | 8/1960 | United Kingdom . |
| 2086803 | 5/1982 | United Kingdom . |

*Primary Examiner*—Robert W. Gibson, Jr.
*Attorney, Agent, or Firm*—Wenderoth, Lind & Ponack

[57] ABSTRACT

A drum in particular for a column having rotary drums includes a lower generally circular shaped horizontal plate, an upper horizontal plate coaxial with the lower plate, and compartments in the shape of sectors defined by radially extending separating elements connected to the two plates. The drum is rotatively mounted on the column. The separating elements are formed by metal sheets whose lower and upper edges include fixing lugs which are fitted in slots provided for this purpose in the plates. The lugs extend through the slots and can then be twisted about an axis parallel to the axis of the column so as to achieve connection between the plates and the separating elements.

11 Claims, 4 Drawing Figures

FILING DRUM

BACKGROUND OF THE INVENTION

The present invention relates to a filing or classification drum, in particular for a column having rotary drums, comprising a lower horizontal generally circular plate, an upper horizontal plate coaxial with the lower plate and compartments in the form of sectors defined by radially extending separating elements connected to the two plates, and means for rotatively mounting the drum on the column. These drums are currently employed as office furniture, in particular for the vertical filing or classification of files, cassettes, etc.

In the manner in which they are at present constructed, the drums of this type most often comprise, as separating elements and as a bearing surface, unperforated or solid walls of sheet steel which are respectively planar and cylindrical, the assembly being achieved by welding in the factory both between the radial planar walls and the cylindrical support wall and moreover between these walls and the lower plate. As a result of this arrangement, on one hand, the quantity of material employed for constructing the drum is greater than that which would be strictly necessary for ensuring the rigidity of the assembly, and, on the other hand, the fabrication requires relatively expensive tooling and a rate of production which is somewhat low. Further, the units produced are space consuming and consequently increase transportation costs.

In order to overcome these drawbacks, there has already been proposed a filing drum in which the separating elements are formed by struts whose ends are bolted or screwed respectively to the lower plate and to an upper plate coaxial with the lower plate. This arrangement is much more aesthetic and reduces the weight of the unit but has the drawback of requiring a relatively great amount of labour, which may have to be specialized, when assembling the device. Moreover, the fabrication of the bent screwthreaded rods constituting the struts is relatively costly and renders the price of such a drum prohibitive for ordinary office equipment.

SUMMARY OF THE INVENTION

There has now been found a filing drum of the conventional type whose extremely simple assembly does not require qualified labour and in which all the main elements—plates, separating elements and fixing means—may be made from sheet steel by simple blanking, cutting out and possibly folding operations, so that the overall size nonetheless remains minimum when transporting the drum before assembly.

The drum according to the invention is of the aforementioned type in which the separating elements are formed by metal sheets whose lower and upper edges include fixing lugs fitting in slots provided for this purpose in the plates, wherein the fixing lugs extending through the plates can then be twisted about axes parallel to the axis of the column so as to achieve the connection between the plates and the separating elements. The assembly of a separating element on a plate may therefore be carried out by a simple vertical positioning of the element in the slots in the plate and a twisting of the lugs which extend through to the other side of the plate, by hand or by means of pliers.

The fixing lugs are advantageously of T or L shape.

The drum may be rendered more stable by providing on the interior edge of the separating element (i.e. on the edge adjacent to the column) a bent reinforcing portion, the bend being vertical and advantageously perpendicular to the plane of the separating element.

Further, it is advantageous to provide an additional lug in the middle of the lower edge of the separating element so as to improve the positioning of the element on the lower plate and contribute to the reinforcement of the rigidity of the drum. This additional lug may be of small size and simple shape (for example rectangular) and does not have to necessarily extend beyond the thickness of the lower plate.

For essentially economic reasons, it is advantageous to fabricate the lower and upper plates and the separating elements from sheet steel.

For convenience, in particular when using the drum as a means for classifying files, the upper plate has a smaller diameter than the lower plate. It may then also include a flange forming a support surface for the vertical edge of the files.

The number of fixing lugs is not critical, but may be conveniently two lugs on the lower edge and one lug on the upper edge when the upper plate has a smaller diameter.

Further, the invention also provides a classification box or basket which may be inserted in one of the compartments in the shape of a sector and fixed to a plate by means of at least one lug, advantageously having a T or L shape, in the same way as the separating elements. Such a box may be of utility for file cards for example.

BRIEF DESCRIPTION OF THE DRAWINGS

The invention will be described in the following description with reference to the accompanying drawings, in which.

DETAILED DESCRIPTION OF THE INVENTION

Figure 1:
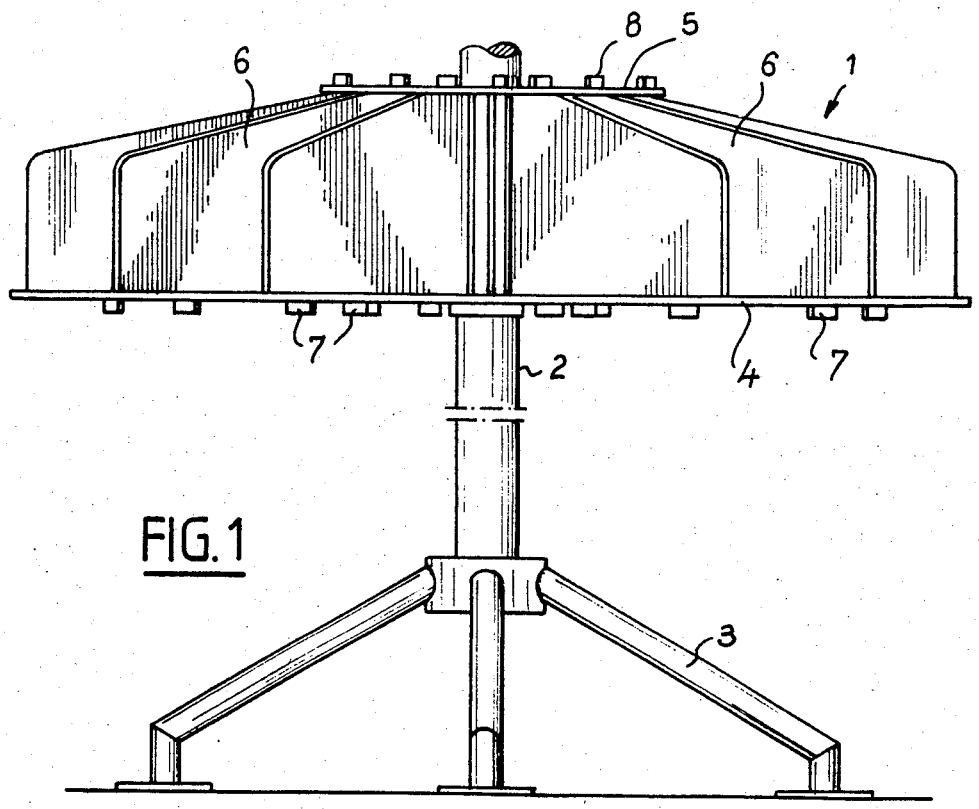
FIG. 1 is an elevational view of a filing drum mounted on a column having rotary drums, partly shown with its stand.

FIG. 1 shows a drum 1 rotatively mounted on a tubular column 2 whose lower end is fixed to a stand 3 resting on the ground. The drum 1 comprises two circular plates 4,5 of sheet steel and concentric with the axis of the column 2, these plates being vertically spaced apart, and separating elements 6 of sheet metal defining with the plates compartments in the shape of sectors. The two plates 4, 5 are rigidly assembled by means of the separating elements 6 with their fixing lugs 7 and 8 twisted after insertion through slots (radial slots) in the plates. The upper plate 5 has a smaller diameter than the lower plate 4 so as to render the classification of the files more convenient.

Figure 2:
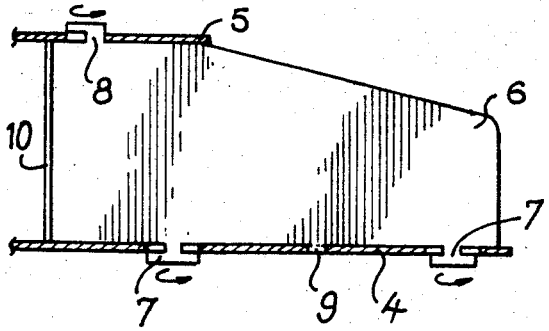
FIG. 2 is a partial sectional view of the positioning of a separating element between two plates.
Figure 3:
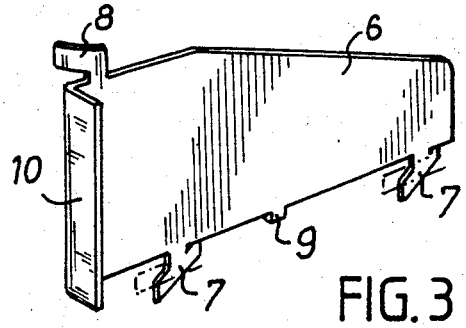
FIG. 3. is a perspective view of a separating element after twisting of fixing lugs thereof.

FIG. 2 shows in more detail a separating element 6 positioned between the two plates 4, 5, in partial section. The separating element 6 has two fixing lugs 7 in the shape of a T and a lug 8 in the shape of an L, and a positioning lug 9, each extending through respective slots provided in the plates. A simple vertical twisting of the fixing lugs 7, 8, i.e. about an axis parallel to the axis of the column 2 (FIG. 3), enables the element 6 to be fixed to the plates 4, 5 and thus the drum 1 to be assembled. The inner edge of the separating element 6 has a folded reinforcing portion 10 while its lower edge has lug 9 in the middle of its length serving to position the element 6 on the lower plate and to reinforce the rigidity of the drum.

Figure 4:
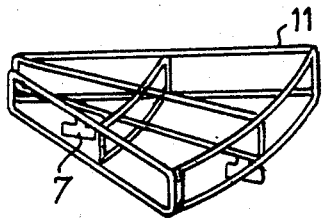
FIG. 4 is a perspective view of a classification box.

The classification box 11 shown in FIG. 4 comprises two fixing lugs 7 in the shape of a T radially disposed on its lower side, the box having substantially the shape of a circular sector defined on the plate 4 by two adjacent separating elements 6, so that it can be inserted in the compartment formed by the sector and secured to the plate 4 by a twisting of the lugs 7 extending through corresponding slots of the plate.

I claim:

1. A filing drum in particular for a column having rotary drums, said drum comprising a lower horizontal plate of generally circular shape, an upper horizontal plate coaxial with the lower plate, and radially extending separating elements defining compartments in the shape of sectors, said separating elements being connected to the two plates, and means for rotatively mounting the drum on the column, the separating elements being formed by metal sheets, each separating element having a lower edge and an upper edge having extending therefrom fixing lugs, the plates having therein slots which receive said fixing lugs, wherein the fixing lugs extend through the plates and are twisted about respective axes parallel to the column so as to provide a connection between the plates and the separating elements.

2. A drum according to claim 1, wherein each fixing lug has a T shape.

3. A drum according to claim 1, wherein each fixing lug has an L shape.

4. A drum according to claim 1, wherein each separating element have an inner edge portion which is bent and constitutes a reinforcement.

5. A drum according to claim 1, wherein the lower edge of each of said separating elements has in the middle thereof an additional lug for positioning the separating element on the lower plate and contributing to the reinforcement of the rigidity of the drum.

6. A drum according to claim 1, wherein the two plates and the separating elements are of sheet steel.

7. A drum according to claim 1, wherein the upper plate has a smaller diameter than the lower plate

8. a drum according to claim 7, wherein the upper edge of each separating element includes a single fixing lug and the lower edge of each separating element includes two fixing lugs.

9. A drum according to claim 1, further comprising at least one filing box inserted in one of the compartments, and at least one fixing lug for fixing the box to a plate and extending through a slot in said plate and being twisted about an axis parallel to the column to connect said box to said plate.

10. A drum according to claim 9, wherein the filing box has substantially the shape of a circular sector defined on the lower plate by two adjacent separating elements and the fixing of said box has a T shape.

11. A drum according to claim 9, wherein the filing box has substantially the shape of a circular sector defined on the lower plate by two adjacent separating elements and the fixing lug of said box has an L shape.

* * * * *